US006037319A

United States Patent [19]

Dickler et al.

[11] Patent Number: 6,037,319

[45] Date of Patent: Mar. 14, 2000

[54] WATER-SOLUBLE PACKETS CONTAINING LIQUID CLEANING CONCENTRATES

[75] Inventors: Lawrence R. Dickler, Cherry Hill, N.J.; J. Barry Ruck, Wynnewood, Pa.

[73] Assignee: Dickler Chemical Laboratories, Inc., Philadelphia, Pa.

[21] Appl. No.: 08/834,681

[22] Filed: Apr. 1, 1997

[51] Int. Cl.[7] ..... C11D 17/00; C11D 17/08; C11D 7/60; C11D 7/32

[52] U.S. Cl. ..... 510/439; 510/461; 510/409; 510/406; 510/337; 510/296

[58] Field of Search ..... 510/295, 296, 510/312, 313, 314, 315, 337, 439, 441, 406, 409, 461

[56] References Cited

U.S. PATENT DOCUMENTS

| | | | |
|---|---|---|---|
| 3,186,869 | 6/1965 | Friedman . | |
| 3,277,009 | 10/1966 | Freifeld et al. . | |
| 3,322,674 | 5/1967 | Friedman . | |
| 3,528,921 | 9/1970 | Gray . | |
| 3,784,005 | 1/1974 | McVay . | |
| 3,790,067 | 2/1974 | Scheier . | |
| 3,859,125 | 1/1975 | Miller et al. . | |
| 3,919,678 | 11/1975 | Penfold . | |
| 4,188,304 | 2/1980 | Clarke et al. . | |
| 4,285,841 | 8/1981 | Barrat et al. . | |
| 4,416,791 | 11/1983 | Haq . | |
| 4,622,161 | 11/1986 | Cornelissens et al. . | |
| 4,747,976 | 5/1988 | Yang et al. . | |
| 4,820,435 | 4/1989 | Zafiroglu . | |
| 4,846,992 | 7/1989 | Fonsny . | |
| 4,973,416 | 11/1990 | Kennedy . | |
| 5,015,513 | 5/1991 | Newbold et al. . | |
| 5,035,930 | 7/1991 | Lacourse et al. . | |
| 5,042,228 | 8/1991 | Pearson . | |
| 5,043,196 | 8/1991 | Lacourse et al. . | |
| 5,080,819 | 1/1992 | Morganson et al. | 252/90 |
| 5,132,036 | 7/1992 | Falou et al. . | |
| 5,158,810 | 10/1992 | Oishi et al. . | |
| 5,234,615 | 8/1993 | Gladfelter et al. . | |
| 5,248,038 | 9/1993 | Hodakowski et al. . | |
| 5,253,759 | 10/1993 | Gouge et al. . | |
| 5,280,835 | 1/1994 | Edwards et al. . | |
| 5,294,361 | 3/1994 | Van den Brom . | |
| 5,310,568 | 5/1994 | Lini . | |
| 5,316,688 | 5/1994 | Gladfelter et al. | 252/90 |
| 5,316,689 | 5/1994 | Farrell . | |
| 5,328,025 | 7/1994 | Hodakowski et al. . | |
| 5,330,047 | 7/1994 | Gouge et al. . | |
| 5,351,831 | 10/1994 | Gouge et al. . | |
| 5,389,425 | 2/1995 | Platt et al. . | |

*Primary Examiner*—Paul Lieberman
*Assistant Examiner*—John M Petruncio
*Attorney, Agent, or Firm*—Caesar, Rivise, Bernstein, Cohen & Pokotilow, Ltd.

[57] ABSTRACT

Water-soluble packets containing liquid cleaning concentrates are provided. The packets are stable despite the presence of any minor amount of water in the cleaning concentrates. Also provided are methods of cleaning in which the packets are added to a volume of water to dissolve and form a cleaning solution, which is used to clean a material.

48 Claims, No Drawings

WATER-SOLUBLE PACKETS CONTAINING LIQUID CLEANING CONCENTRATES

SPECIFICATION

1. Field of the Invention

This invention relates to liquid cleaning compositions packaged within water-soluble packets.

2. Background of the Invention

Liquid cleaning compositions are often considered to be more convenient to employ than dry powered or particulate products and, therefore, have found substantial favor with consumers. They are readily measurable, speedily dissolved in water, capable of being easily applied in concentrated solutions or dispersions to soiled areas to be cleaned and are non-dusting, and they usuallyoccupy less storage space. Furthermore, liquids are more environmentally sound since they eliminate the requirement for organic salts, including phosphates, and enable a reduction in waste volume. Additionally, the liquid cleaning compositions may have incorporated in their formulations materials which could not stand drying operations without deterioration, which materials are often desirably employed in the manufacture of particular cleaning products.

The unit packaging of cleaning compositions in sachets has already been proposed in the literature, but in practice, bulk packaging of both powdered and liquid cleaning compositions in cartons, drums, bottles and the like is generally employed. However, wastage or underdosage tends to occur when the consumer is left to judge the correct amount of a product to use. Unit packaging alleviates these problems and also avoids skin contact with the cleaning composition, so that more highly alkaline and acid compositions can be used.

Sachets for unit packaging of detergent powders are disclosed in U.S. Pat. No. 4,188,304, which discloses sachets of water-insoluble, water-permeable material, which are clearly unsuitable for the packaging of liquids, and sachets designed to open in use. The latter type of sachet requires seals that are sensitive to the wash water, and they would accordingly be unsuitable, in general, for the packaging of liquids.

U.S. Pat. No. 3,277,009 discloses packets made of water-soluble film and their use for the packaging of, inter alia, solid detergent compositions and non-aqueous liquids such as petrol and carbon tetrachloride. Such packets were clearly considered unsuitable for packaging liquids having an appreciable water content since such liquids would have been expected to attack the packet walls.

Some have proposed to solve this problem by providing the cleaning composition in the form of a paste or gel which will not dissolve the film. However, liquid cleaning compositions possess advantages over pastes and gels, including faster delivery and dispersability of the cleaning ingredients.

Others have proposed coating the internal walls of the packet with water-resistant materials, such as a waxy or oleaginous material (see, e.g., U.S. Pat. Nos. 3,186,869 and 3,322,674) or a layer of plastic (see, e.g., U.S. Pat. No. 4,416,791). Unfortunately, such packets are more difficult and expensive to produce than simple, uncoated packets.

Still others have proposed multilayered packets comprising a combination of water-soluble and water-insoluble layers. For example, U.S. Pat. No. 3,790,067 discloses a disposable container having an inner layer of water-insoluble polymeric film material and an outer layer of water-soluble polymeric material. The outer layer is relatively strong, and the inner layer is sufficiently thin to be shredded under normal atmospheric forces, or the weight of material in the container, once the outer layer has dissolved away. Again, such packages are more difficult and expensive to produce than simple, uncoated packages.

U.S. Pat. No. 4,973,416 discloses an aqueous liquid laundry detergent comprising from about 10% to about 24% by weight of water and a substantially organic neutralization system which is contained in a package, preferably a pouch or packet containing a unit dose of said liquid laundry detergent, said package comprising a water soluble film-forming material. Compatibility of the liquid laundry detergent with the water-soluble film is said to be achieved by the use of a critical water level in the liquid laundry detergent in conjunction with a substantially all organic neutralization system.

The patent also teaches the use of a solvent system which is comprised of an alkanol, for example, ethanol and/or a polyol, for example, propylene glycol, which operates in conjunction with the water in the liquid laundry detergent can be used to enhance the compatibility of the liquid laundry detergent with the water-soluble film and to ensure the isotropic nature of the liquid laundry detergent.

However, until now, it had not been considered possible to produce a stable water-soluble cleaning packet comprising an uncoated, single-layered containment system containing a liquid cleaning composition containing minor amounts of water below about 10%. In particular, chelating agents necessary to assist the detergency of detergent systems have been water-soluble, and thus unsuitable for such substantially nonaqueous compositions.

SUMMARY OF THE INVENTION

Accordingly, the invention provides a stable water-soluble cleaning packet comprising an uncoated, single-layered containment system containing a liquid cleaning composition.

Cleaning packets according to the invention include liquid cleaning concentrates which are compatible with the water-soluble containers in which they are stored. The cleaning concentrates do not substantially degrade the containers or breach their containment therewithin, despite the presence of water in at least some cleaning concentrates according to the invention.

The cleaning packets are suitable for cleaning a variety of materials, and enable relatively safe and efficient handling of cleaning concentrates by both skilled and unskilled laborers.

The invention also provides a method for cleaning an object, comprising the use of such cleaning packets, wherein the method comprises providing a volume of water, adding said cleaning packet to said volume of water to dissolve the water-soluble container and dilute the cleaning concentrate within the container to form an aqueous cleaning composition, and applying the aqueous cleaning composition to a material to clean said material.

DETAILED DESCRIPTION OF PREFERRED EMBODIMENTS

The container of the invention comprises a water-soluble material. For purposes of the invention, a water-soluble material is defined as a material which substantially dissolves in response to being contacted with water.

It is preferred that the water-soluble material be in the form of a film. Suitable materials for the film include polyvinyl alcohol and partially hydrolyzed polyvinyl acetate and alginates. Films of polyvinyl alcohol are most preferred.

The invention encompasses the use of materials having water-solubilities ranging from partial solubility in hot water to complete solubility in cold water. For example, in the case of a packet containing a cleaning concentrate for laundering textiles, it is sufficient that water at wash temperatures will cause enough disintegration of the film to allow release of the contents from the package into the wash water.

The thickness of the film itself should be sufficient to give it the required mechanical strength. Typically, the thickness of the film will lie within the range of from 0.5 to 10 mils. High bursting strength is also desirable. The film is also advantageously of high heat-sealability, since heat-sealing represents a convenient and inexpensive method of making packages according to the invention.

A particularly preferred film for use in the invention is Monosol® (Monosol, a Division of Chris Craft International, Gary, Ind., U.S.A.) having a thickness of about 2 to about 4 mils.

The film or container is preferably uncoated to minimize production costs. Unlike certain prior art packets, the contents of the packets according to the invention are compatible with the water-soluble container, and thus, protective coatings are not necessary to provide adequate stability to the packet.

The packet of the invention is conveniently in the form of a bag or sachet. The packet may be formed from one or more sheets of a packaging film or from a tubular section of such film, but it is most conveniently formed from a single folded sheet or from two sheets, sealed together at the edge regions either by means of an adhesive or, preferably, by heat-sealing. A preferred form of the packet according to the invention is a rectangular one formed from a single folded sheet sealed on three sides, with the fourth side sealed after filling the packet with liquid cleaning composition. A rectangular-shaped packet is more easily manufactured and sealed than other configurations when using conventional packaging equipment.

The liquid cleaning composition of the invention is formulated in a manner which makes it compatible with the water-soluble film for purposes of packing, shipping, storage, and use.

It is preferred to limit the amount of water in the liquid cleaning concentrate to less than 10 wt. % of the composition. In embodiments, it is preferred to limit the amount of water to less than 7.5 wt. % or less than 5 wt. %. Contrary to the teachings of U.S. Pat. No. 4,973,416 at column 2, lines 53–61, the liquid cleaning concentrate packets according to the invention are stable despite containing cleaning concentrates having less than 10 wt. % water.

Liquid cleaning concentrates suitable for use in this invention can contain, for example, an anionic surfactant, and/or an ethoxylated nonionic surfactant, an organic neutralization system, and a solvent system comprising water and, preferably, an organic solvent and a chelating agent suitable for substantially nonaqueous environments, most preferably dimethyl glyoxime. Optional ingredients include enzymes, enzyme stabilizing agents, soil removal agents, antiredeposition agents, foam stablizers, opacifiers, antioxidants, bactericides, dyes, fragrances and brighteners. A more detailed description of optional ingredients can be found in U.S. Pat. No. 4,285,841.

To meet the constraints of the present invention which include both phase stability of the liquid cleaning concentrate and, most importantly, the surprising compatibility of the liquid cleaning concentrate with the water-soluble container, certain liquid cleaning concentrates of the invention require an organic system.

In embodiments, the organic system contains no more than 0.10 moles of organic amine per 100 grams of cleaning concentrate, and/or no more than 1 wt. % organic amine. The organic amine is preferably selected from the group consisting of monoethanolamine, diethanolamine, triethanolamine, and mixtures thereof. Monoethanolamine is most preferred because it enhances product stability and cleaning performance and has acceptable odor characteristics.

Other organic amines such as isopropanol amine, morphaline, etc., can be used although they are normally more expensive. Other amines can be used but preferably should have no, or minimal, odor.

Inorganic neutralizers are preferably not used in the liquid cleaning concentrates suitable for use in this invention in any substantial amount because they are generally insoluble in the concentrates. Inorganic neutralizers include, for example, sodium and potassium hydroxides.

The solvent system can comprise water which, as discussed above, is preferably present in an amount less than 10% by weight of the composition. A particularly suitable solvent system comprises ethanol and a polyol in addition to water. Ethanol is preferably present at a level of about 0.5 wt. % to about 50 wt. %. Isopropanol can be used in place of ethanol. Any polyol containing 2 to 6 carbon atoms and 2 to 6 hydroxy groups can be used. These polyols include ethylene glycol, propylene glycol, hexylene glycol and glycerine. Hexylene glycol and propylene glycol are particularly preferred.

Suitable anionic surfactants include the water-soluble salts, particularly the alkali metal salts, of sulfonated surfactants such as those disclosed in U.S. Pat. Nos. 4,285,841 and 3,919,678. These include the water soluble salts of the alkylbenzene sulfonates in which the alkyl group contains from about 8 to about 15 carbon atoms in a straight or branched chain configuration. Linear straight chain alkylbenzene sulfonates in which the average number of carbon atoms in the alkyl group is from about 11 to about 13 are particularly useful.

Cleaning compositions prepared from the cleaning concentrates according to the invention can have a broad range of pH values, for example, from about 1 to about 13. In some embodiments, the pH is 2 to 4, in other embodiments, the pH is above 8.5, and in still other embodiments, the pH is 10 to 11.

The liquid cleaning concentrate is preferably contained within a single layer film having an internal surface directly contacting said concentrate, and having an external surface which is an outermost portion of said cleaning packet.

Packets according to the invention can be used to clean a variety of materials. In embodiments, the method according to the invention comprises providing a cleaning packet comprising a liquid cleaning concentrate and a water-soluble container containing said concentrate; providing a volume of water; adding said cleaning packet to said volume of water to dissolve the water-soluble container and dilute the cleaning concentrate within the container to form an aqueous cleaning composition; and applying the aqueous cleaning composition to a material to clean said material.

Typically, the packets are formulated for a particular use; however, multipurpose cleaning packets are within the scope of the invention. Such multipurpose cleaning packets can be formulated for universal use, or for something less than universal use, such as use on non-textiles.

The invention will be illustrated in more detail with reference to the following Examples, but it should be understood that the present invention is not deemed to be limited thereto. Unless otherwise stated, all parts, percentages, and ratios are by weight.

EXAMPLE 1

Neutral Floor Cleaner

A neutral floor cleaner is prepared by mixing the following ingredients:

| | |
|---|---|
| Dimethyl monoethyl ether | 75.49% |
| Sodium lauryl sulfate | 8.00% |
| Dimethyl glyoxime | 0.50% |
| Monoethanolamine (99%) | 0.40% |
| Nonyl phenoxypolyethyleneoxy ethanols (NPX) (9.5 moles type) | 13.61% |
| Water | 2.00% |

The dimethyl monoethyl ether (hereinafter DM) is agitated prior to addition of the sodium lauryl sulfate (SLS PWD Poly Step B3, hereinafter SLS), with agitation continued until the SLS and dimethyl glyoxime are thoroughly dissolved. After combining the foregoing ingredients, 2.25 fluid ounces of fragrance (Sundance) and 0.0544 grams of uranine yellow dye are added per gallon of cleaning composition.

EXAMPLE 2

Heavy-Duty Floor Cleaner

A heavy-duty floor cleaner is prepared by mixing the following ingredients:

| | |
|---|---|
| 2-Butoxyethanol | 60.03% |
| Sodium lauryl sulfate | 1.00% |
| Dimethyl glyoxime | 0.50% |
| Monoethanolamine (99%) | 15.00% |
| NPX (9.5 moles type) | 5.00% |
| Hexylene glycol | 18.47% |

The 2-butoxyethanol is agitated prior to addition of the sodium lauryl sulfate. After combining the foregoing ingredients, 0.80 fluid ounces of fragrance (Sassafras Fragrance 42180) and 0.8847 grams of Orco Milling Violet are added per gallon of cleaning concentrate.

EXAMPLE 3

Neutralizer/Conditioner

A neutralizer/conditioner is prepared by mixing the following ingredients:

| | |
|---|---|
| 25% citric acid/hexylene glycol solution | 80.00% |
| Hexylene glycol | 10.75% |
| NPX (9.5 moles type) | 0.75% |
| Isopropyl alcohol-99% | 8.50% |

The hexylene glycol and NPX are added to the citric acid solution and mixed for 10 minutes. The composition will thin after addition of isopropyl alcohol hereinafter IPA).

EXAMPLE 4

Laundry Detergent

A laundry detergent is prepared by mixing the following ingredients:

| | |
|---|---|
| DM | 73.87% |
| SLS | 6.00% |
| Dimethyl glyoxime | 1.00% |
| IPA-99% | 0.50% |
| Trazinyl stilbene (Tinopal UNPA-GX) | 0.50% |
| Monoethanolamine | 1.52% |
| Linear alcohol ethoxylate (Surfonic LF-17) | 13.61% |
| d-limonene | 3.00% |

The DM, SLS and dirnethyl glyoxime are combined first and allowed to mix for 10 minutes. The IPA and Tinopal are premixed to form a thick paste, and then added to the mixture and allowed to mix for 10 minutes before adding the monoethanolamine.

EXAMPLE 5

Dish Detergent and Pot/Pan Cleaner

A dish detergent and pot/pan cleaner is prepared by mixing the following ingredients:

| | |
|---|---|
| Hexylene glycol | 10.00% |
| NPX (9.5 moles type) | 40.00% |
| Amine oxide (FMB A0-8) | 6.50% |
| S-10 coconut amide (2:1 cocoa diethanolamide condensate) (ESI) | 43.50% |

After combining the foregoing ingredients, 7.50 fluid ounces of fragrance (Lemon Joy) are added per gallon of cleaning concentrate.

EXAMPLE 6

Flatware Presoak

A flatware presoak is prepared by mixing the following ingredients:

| | |
|---|---|
| NPX (9.5 moles type) | 42.00% |
| Amine oxide (FMB A0-8) | 5.00% |
| S-10 coconut amide | 36.00% |
| DM | 17.00% |

After combining the foregoing ingredients, 2.70 fluid ounces of fragrance (almond) and 0.40 grams of alizarine green GN are added per gallon of cleaning concentrate.

EXAMPLE 7

Delimer

A delimer is prepared by mixing the following ingredients:

| | |
|---|---|
| 25% Citric acid/hexylene glycol solution | 80.00% |
| Hexylene glycol | 10.75% |
| NPX (9.5 moles type) | 0.75% |
| Isopropyl alcohol-99% | 8.50% |

The hexylene glycol and NPX are added to the citric acid solution and mixed for 10 minutes. The composition will thin after addition of isopropyl alcohol. Some of the isopropyl alcohol should be retained as a solvent for adding dye (Alizarine Green GN, 0.3840 grams/gal of composition) to the composition.

EXAMPLE 8

Glass and Hard Surface Cleaner

A glass and hard surface cleaner is prepared by mixing the following ingredients:

| | |
|---|---|
| IPA-99% | 55.00% |
| 2-butoxyethanol | 37.00% |
| Monoethanolamine-99% | 3.00% |
| NPX (30 moles type) | 5.00% |

After combining the foregoing ingredients, 7.50 fluid ounces of fragrance (Windex 46952) and 1.62 grams of cyan dye (LX-9544) are added per gallon of cleaning concentrate.

EXAMPLE 9

Citrus All-Purpose Cleaner

A citrus all-purpose cleaner is prepared by mixing the following ingredients:

| | |
|---|---|
| 2-butoxyethanol | 13.50% |
| Hexylene glycol | 15.00% |
| d-limonene | 15.00% |
| SLS | 4.00% |
| Dimethyl glyoxime | 0.50% |
| Monoethanolamine-99% | 2.00% |
| Alkanolamide (NINOL 201) | 2.50% |
| NPX (9.5 moles type) | 47.50% |

The first four ingredients in the foregoing list are mixed together for 10 minutes before adding dirnethyl glyoxime. After mixing for a further 10 minutes, the balance of the ingredients are added. After combining the foregoing ingredients, 1.37 fluid ounces of fragrance (Lemon Joy) and 1.20 grams of wool orange are added per gallon of cleaning concentrate.

EXAMPLE 10

Odor Suppressant

An odor suppressant is prepared by mixing the following ingredients:

| | |
|---|---|
| IPA-99% | 25.00% |
| Hexamethylene tetraamine | 1.00% |
| Propylene glycol (USP) | 18.30% |
| NPX (9.5 moles type) | 13.50% |
| Apple concentrate | 21.10% |
| Glassworks fragrance | 21.10% |

The hexamethylene tetraamine is mixed into the IPA. After combining the balance of the ingredients, 0.1353 grams of Alizarine Green GN and 0.0410 grams of Metanil Yellow Dye are added per gallon of cleaning concentrate.

EXAMPLE 11

Non-Acid Bowl and Bathroom Cleaner

A non-acid bowl and bathroom cleaner is prepared by mixing the following ingredients:

| | |
|---|---|
| 2-butoxyethanol | 15.40% |
| Hexylene glycol | 15.00% |
| d-limonene | 15.00% |
| SLS | 2.00% |
| Dimethyl glyoxime | 0.50% |
| Monoethanolamine-99% | 2.00% |

-continued

| | |
|---|---|
| NINOL 201 | 2.50% |
| NPX (9.5 moles type) | 47.60% |

After combining the foregoing ingredients, 1.37 fluid ounces of fragrance (Lemon Joy) and 0.80 grams of Red Oil Dye No. 2144 are added per gallon of cleaning concentrate.

EXAMPLE 12

Acidic Bowl and Bathroom Cleaner

An acidic bowl and bathroom cleaner is prepared by mixing the following ingredients:

| | |
|---|---|
| 25% citric acid/hexylene glycol solution | 80.00% |
| Hexylene glycol | 9.00% |
| NPX (9.5 moles type) | 2.50% |
| Isopropyl alcohol-99% | 8.50% |

The hexylene glycol and NPX are added to the citric acid solution and mixed for 10 minutes. The composition will thin after addition of isopropyl alcohol. Some of the isopropyl alcohol should be retained as a solvent for adding dye (Rhodamine B Extra, 0.1970 grams/gal of composition) to the composition. Baby powder fragrance is also added in an amount of 8.00 fluid ounces per gallon of composition.

EXAMPLE 13

Ball Wash

A ball wash is prepared by mixing the following ingredients:

| | |
|---|---|
| Hexylene glycol | 98.95% |
| Surfornc LF-17 | 1.00% |
| N-alkyl dimethylbenzyl ammonium (BARDAC 208M) | 0.05% |

After combining the foregoing ingredients, 0.50 fluid ounces of lemon fragrance are added per gallon of cleaning concentrate.

EXAMPLE 14

Cleaning Concentrate Packets

The compositions of Examples 1–13 are packaged in water-soluble films as follows. Two polyvinyl alcohol films (M-8630, Monosol) measuring approximately 1 to 6 inches wide by 1 to 6 inches long (with the size selected based on the desired volume of the resulting packet) are heat sealed to each other along both longitudinal edges and along a line spaced about 0.2 inches from the bottom edge. As summarized in the following table, each polyvinyl alcohol packet is then filled with a unit dose (UD, in grams) of one of the example cleaning concentrates (EX) through the opening in the top portion of the pouch (see the following Table). Thereafter, the top portion is also heat sealed along a line spaced about 0.2 inches from the top edge.

| EX | 1 | 2 | 3 | 4 | 5 | 6 | 7 | 8 | 9 | 10 | 11 | 12 |
|---|---|---|---|---|---|---|---|---|---|---|---|---|
| UD | 30 | 45 | 45 | 45 | 30 | 20 | 12 | 12 | 12 | 12 | 12 | 12 |

Each packet is added to an amount of water appropriate for the unit dosage of cleaning concentrate contained therein. The packets release their respective cleaning concentrates upon addition to water.

While the invention has been described in detail and with reference to specific examples thereof, it will be apparent to one skilled in the art that various changes and modifications can be made therein without departing from the spirit and scope thereof.

What is claimed is:

1. A cleaning packet comprising a liquid cleaning concentrate and a water-soluble container containing said concentrate, wherein said cleaning concentrate comprises less than 7.5 wt. % water, and said container comprises a single layer film having an internal surface directly contacting said concentrate, and having an external surface which is an outermost portion of said cleaning packet.

2. The cleaning packet according to claim 1, wherein said cleaning concentrate comprises not more than 2 wt. % water.

3. The cleaning packet according to claim 1, wherein said cleaning concentrate comprises less than 5.0 wt. % water.

4. The cleaning packet according to claim 1, wherein said cleaning concentrate comprises no more than 0.10 moles of organic amine per 100 grams of said concentrate.

5. The cleaning packet according to claim 4, wherein the cleaning concentrate comprises no more than 1 wt. % organic amine.

6. The cleaning packet according to claim 1, wherein the single layer film has a thickness of about 2 mils to about 4 mils.

7. The cleaning packet according to claim 1, wherein the single layer film is a polyvinyl alcohol film.

8. The cleaning packet according to claim 7, wherein the container consists essentially of said polyvinyl alcohol film.

9. The cleaning packet according to claim 1, wherein said cleaning concentrate comprises about 80.00 wt. % of a 25 wt. % citric acid/hexylene glycol solution, about 10.75 wt. % hexylene glycol, about 0.75 wt. % nonyl phenoxypolyethyleneoxy ethanol and about 8.50 wt. % of 99 wt. % isopropyl alcohol.

10. The cleaning packet according to claim 1, wherein said cleaning concentrate comprises about 10.00 wt. % hexylene glycol, about 40.00 wt. % nonyl phenoxypolyethyleneoxy ethanol, about 6.50 wt. % amine oxide and about 43.50 wt. % S-10 coconut amide.

11. The cleaning packet according to claim 1, wherein said cleaning concentrate comprises about 55.00 wt. % of 99 wt. % isopropyl alcohol, about 37.00 wt. % 2-butoxyethanol, about 3.00 wt. % of 99 wt. % monoethanolamine and about 5.00 wt. % nonyl phenoxypolyethyleneoxy ethanol.

12. The cleaning packet according to claim 1, wherein said cleaning concentrate comprises about 25.00 wt. % of 99 wt. % isopropyl alcohol, about 1.00 wt. % of hexamethylene tetraamine, about 18.30 wt. % propylene glycol, about 13.50 wt. % nonyl phenoxypolyethyleneoxy ethanol, about 21.10 wt. % apple concentrate and about 21.10 wt. % glassworks fragrance.

13. The cleaning packet according to claim 1, wherein said cleaning concentrate comprises about 80.00 wt. % of a 25 wt. % citric acid/hexylene glycol solution, about 9.00 wt. % hexylene glycol, about 2.50 wt. % nonyl phenoxypolyethyleneoxy ethanol and about 8.50 wt. % of 99 wt. % isopropyl alcohol.

14. The cleaning packet according to claim 1, wherein said cleaning concentrate comprises about 98.95 wt. % hexylene glycol, about 1.00 wt. % alcohol ethoxylate, and about 0.05 wt. % N-alkyl dimethylbenzyl amnmonium.

15. A method for cleaning a non-textile surface, said method comprising:

providing a cleaning packet according to claim 1;

providing a volume of water;

adding said cleaning packet to said volume of water to dissolve the water-soluble container and dilute the cleaning concentrate within the container to form an aqueous cleaning composition; and applying the aqueous cleaning composition to a non-textile surface to clean said surface.

16. The method according to claim 15, wherein said cleaning concentrate comprises not more than 2 wt. % water.

17. The method according to claim 15, wherein said cleaning concentrate comprises less than 5 wt. % water.

18. The method according to claim 15, wherein said cleaning concentrate comprises no more than 0.10 moles of organic amine per 100 grams of said concentrate.

19. The method according to claim 18, wherein the cleaning concentrate comprises no more than 1 wt. % organic amine.

20. The method according to claim 15, wherein the container comprises a single layer film having an internal surface directly contacting said concentrate, and having an external surface which is an outermost portion of said cleaning packet.

21. The method according to claim 20, wherein the single layer film has a thickness of about 2 mils to about 4 mils.

22. The method according to claim 20, wherein the single layer film is a polyvinyl alcohol film.

23. The method according to claim 22, wherein the container consists essentially of said polyvinyl alcohol film.

24. The method according to claim 15, wherein said cleaning concentrate is diluted to form a conditioner composition which cleans and conditions said surface, said cleaning concentrate comprising about 80.00 wt. % of a 25 wt. % citric acid/hexylene glycol solution, about 10.75 wt. % hexylene glycol, about 0.75 wt. % nonyl phenoxypolyethyleneoxy ethanol and about 8.50 wt. % of 99 wt. % isopropyl alcohol.

25. The method according to claim 15, wherein said cleaning concentrate is diluted to form a dishwashing composition which is applied to the surface of a dish, pot or pan to clean said surface, said cleaning concentrate comprising about 10.00 wt. % hexylene glycol, about 40.00 wt. % nonyl phenoxypolyethyleneoxy ethanol, about 6.50 wt. % amine oxide and about 43.50 wt. % S-10 coconut amide.

26. The method according to claim 15, wherein said cleaning concentrate is diluted to form a deliming composition which is applied to a corroded surface to delime and clean said surface, said cleaning concentrate comprising 80.00 wt. % of a 25 wt. % citric acid/hexylene glycol solution, about 10.75 wt. % hexylene glycol, about 0.75 wt. % nonyl phenoxypolyethyleneoxy ethanol and about 8.50 wt. % of 99 wt. % isopropyl alcohol.

27. The method according to claim 15, wherein said cleaning concentrate is diluted to form a glass and hard surface cleaning composition which is applied to a hard surface to clean said surface, said cleaning concentrate comprising about 55.00 wt. % of 99 wt. % isopropyl alcohol, about 37.00 wt. % 2-butoxyethanol, about 3.00 wt. % of 99 wt. % monoethanolamine and about 5.00 wt. % nonyl phenoxypolyethyleneoxy ethanol.

28. The method according to claim 15, wherein said cleaning concentrate is diluted to form an odor suppressing cleaning composition which is applied to a hard surface to suppress odors emanating from said surface and to clean said surface, said cleaning concentrate comprising about 25.00 wt. % of 99 wt. % isopropyl alcohol, about 1.00 wt. % hexamethylene tetraamine, about 18.30 wt. % propylene glycol, about 13.50 wt. % nonyl phenoxypolyethyleneoxy ethanol, about 21.10 wt. % apple concentrate and about 21.10 wt. % glassworks fragrance.

29. The method according to claim 15, wherein said cleaning concentrate is diluted to form an acid bowl and bathroom cleaning composition which is applied to the surface of a bathroom structure to clean said surface, said cleaning concentrate comprising about 80.00 wt. % of a 25 wt. % citric acid/hexylene glycol solution, about 9.00 wt. % hexylene glycol, about 2.50 wt. % nonyl phenoxypolyethyleneoxy ethanol and about 8.50 wt. % of 99 wt. % isopropyl alcohol.

30. The method according to claim 15, wherein said cleaning concentrate is diluted to form a ball cleaning composition which is applied to the surface of a ball to clean said surface, said cleaning concentrate comprising about 98.95 wt. % hexylene glycol, about 1.00 wt. % alcohol ethoxylate, and about 0.05 wt. % N-alkyl dimethylbenzyl ammonium.

31. The method according to claim 15, wherein said aqueous cleaning composition has a pH of 2 to 4.

32. The method according to claim 15, wherein said aqueous cleaning composition has a pH above 8.5.

33. The method according to claim 15, wherein said aqueous cleaning composition has a pH of 10 to 11.

34. The method according to claim 15, wherein said cleaning concentrate comprises dimethyl glyoxime.

35. A cleaning packet comprising a liquid cleaning concentrate and a water-soluble container containing said concentrate, wherein said cleaning concentrate comprises dimethyl glyoxime and less than 10 wt. % water.

36. The cleaning packet according to claim 35, wherein said cleaning concentrate comprises about 75.49 wt. % diinethyl monoethyl ether, about 8.00 wt. % sodium lauryl sulfate, about 0.50 wt. % dimethyl glyoxime, about 0.40 wt. % of 99 wt. % monoethanolamine, about 13.61 wt. % nonyl phenoxypolyethyleneoxy ethanol and about 2.00 wt. % water.

37. The cleaning packet according to claim 35, wherein said cleaning concentrate comprises about 60.03 wt. % 2-butoxyethanol, about 1.00 wt. % sodium lauryl sulfate, about 0.50 wt. % dimethyl glyoxime, about 15.00 wt. % of 99 wt. % monoethanolamine, about 5.00 wt. % nonyl phenoxypolyethyleneoxy ethanol and about 18.47 wt. % hexylene glycol.

38. The cleaning packet according to claim 35, wherein said cleaning concentrate comprises about 73.87 wt. % diglycol monomethyl ether, about 6.00 wt. % sodium lauryl sulfate, about 1.00 wt. % dimethyl glyoxime, about 0.50 wt. % of 99 wt. % trazinyl stilbene, about 1.52 wt. % monoethanolamine, about 13.61 wt. % alcohol ethoxylate and about 3.00 wt. % d-limonene.

39. The cleaning packet according to claim 35, wherein said cleaning concentrate comprises about 42.00 wt. % nonyl phenoxypolyethyleneoxy ethanol, about 5.00 wt. % amine oxide, about 36.00 wt. % S-10 coconut amide and about 17.00 wt. % dimethyl glyoxime.

40. The cleaning packet according to claim 35, wherein said cleaning concentrate comprises about 13.50 wt. % 2-butoxyethanol, about 15.00 wt. % hexylene glycol, about 15.00 wt. % d-limonene, about 4.00 wt. % sodium lauryl sulfate, about 0.50 wt. % dimethyl glyoxime, about 2.00 wt. % of 99 wt. % monoethanolamine, about 2.50 wt. % alkanolamide and about 47.50 wt. % nonyl phenoxypolyethyleneoxy ethanol.

41. The cleaning packet according to claim 35, wherein said cleaning concentrate comprises about 15.40 wt. % 2-butoxyethanol, about 15.00 wt. % hexylene glycol, about 15.00 wt. % d-limonene, about 2.00 wt. % sodium lauryl sulfate, about 0.50 wt. % dimethyl glyoxime, about 2.00 wt. % of 99 wt. % monoethanolamine, about 2.50 wt. % alkanolamide and about 47.60 wt. % nonyl phenoxypolyethyleneoxy ethanol.

42. A method for cleaning laundry, said method comprising:

providing a cleaning packet according to claim 38;

providing a volume of water;

adding said cleaning packet to said volume of water to dissolve the water-soluble container and dilute the cleaning concentrate within the container to form an aqueous cleaning composition; and applying the aqueous cleaning composition to said laundry to clean said laundry.

43. A method for cleaning a non-textile surface, said method comprising:

providing a cleaning packet according to claim 35;

providing a volume of water;

adding said cleaning packet to said volume of water to dissolve the water-soluble container and dilute the cleaning concentrate within the container to form an aqueous cleaning composition; and applying the aqueous cleaning composition to a non-textile surface to clean said surface.

44. The method according to claim 15, wherein said cleaning concentrate is diluted to form a neutral floor cleaning composition which is applied to the surface of a floor to clean said surface, said cleaning concentrate comprising about 75.49 wt. % dimethyl monoethyl ether, about 8.00 wt. % sodium lauryl sulfate, about 0.50 wt. % dimethyl glyoxime, about 0.40 wt. % of 99 wt. % monoethanolamine, about 13.61 wt. % nonyl phenoxypolyethyleneoxy ethanol and about 2.00 wt. % water.

45. The method according to claim 43, wherein said cleaning concentrate is diluted to form a floor cleaning composition which is applied to the surface of a floor to clean said surface, said cleaning concentrate comprising about 60.03 wt. % 2-butoxyethanol solvent, about 1.00 wt. % sodium lauryl sulfate, about 0.50 wt. % dimethyl glyoxime, about 15.00 wt. % of 99 wt. % monoethanolamine, about 5.00 wt. % nonyl phenoxypolyethyleneoxy ethanol and about 18.47 wt. % hexylene glycol.

46. The method according to claim 15, wherein said cleaning concentrate is diluted to form a flatware pre-soak composition which is applied to the surface of flatware to clean said surface, said cleaning concentrate comprising about 42.00 wt. % nonyl phenoxypolyethyleneoxy ethanol, about 5.00 wt. % amine oxide, about 36.00 wt. % S-10 coconut amide and about 17.00 wt. % dimethyl glyoxime.

47. The method according to claim 15, wherein said cleaning concentrate is diluted to form a citrus all-purpose cleaning composition which is applied to a hard surface to clean said surface, said cleaning concentrate comprising about 13.50 wt. % 2-butoxyethanol, about 15.00 wt. % hexylene glycol, about 15.00 wt. % d-limonene, about 4.00 wt. % sodium lauryl sulfate, about 0.50 wt. % dimethyl glyoxime, about 2.00 wt. % of 99 wt. % monoethanolamine, about 2.50 wt. % alkanolamide and about 47.50 wt. % nonyl phenoxypolyethyleneoxy ethanol.

48. The method according to claim 15, wherein said cleaning concentrate is diluted to form a non-acid bowl and bathroom cleaning composition which is applied to the surface of a bathroom structure to clean said surface, said cleaning concentrate comprising about 15.40 wt. %

2-butoxyethanol, about 15.00 wt. % hexylene glycol, about 15.00 wt. % d-limonene, about 2.00 wt. % sodium lauryl sulfate, about 0.50 wt. % dimethyl glyoxime, about 2.00 wt. % of 99 wt. % monoethanolamine, about 2.50 wt. % alkanolamide and about 47.60 wt. % nonyl phenoxypolyethyleneoxy ethanol.

* * * * *